US005915982A

United States Patent [19]

Kashiyama et al.

[11] Patent Number: 5,915,982

[45] Date of Patent: Jun. 29, 1999

[54] CONNECTORS ENGAGEMENT STRUCTURE

[75] Inventors: Motohisa Kashiyama; Osamu Sugiyama; Hiroshi Aoki; Norio Matsumura; Haruki Yoshida, all of Shizuoka-ken; Takahiro Yoneda, Kanagawa-ken, all of Japan

[73] Assignee: Yazaki Corporation, Tokyo, Japan

[21] Appl. No.: 08/880,407

[22] Filed: Jun. 23, 1997

[30] Foreign Application Priority Data

Jun. 24, 1996 [JP] Japan ..... 8-163187

[51] Int. Cl.[6] ..... H01R 13/62

[52] U.S. Cl. ..... 439/157; 439/347

[58] Field of Search ..... 439/157, 310, 439/347

[56] References Cited

U.S. PATENT DOCUMENTS

| | | | |
|---|---|---|---|
| 4,875,873 | 10/1989 | Ishuzuka et al. | 439/347 |
| 5,244,400 | 9/1993 | Hatagishi | 439/157 |
| 5,575,676 | 11/1996 | Tsukakoshi et al. | 439/157 |
| 5,681,175 | 10/1997 | Busse et al. | 439/347 |

FOREIGN PATENT DOCUMENTS

| | | | |
|---|---|---|---|
| 0 363 804 | 4/1990 | European Pat. Off. | H01R 13/629 |
| 0 587 174 A2 | 3/1994 | European Pat. Off. | H01R 13/629 |
| 3-74483 | 7/1991 | Japan . | |

OTHER PUBLICATIONS

EPO Search Report.

*Primary Examiner*—Neil Abrams
*Assistant Examiner*—Javaid Nasri
*Attorney, Agent, or Firm*—Finnegan, Henderson, Farabow, Garrett & Dunner, L.L.P.

[57] ABSTRACT

Slide members 43 are provided on the upper and lower portions of a hood section 27 of a male connector 25 so that the slide members 43 are movable in Y direction orthogonal with X direction in which the male connector 25 is engaged with a female connector 35. Guide grooves which are slanted in mutually opposite directions in the sliding direction are provided on the inner surface side at which the slide members 43 face each other. Guide pins 37*a* and 37*b* guided to the guide grooves are provided on the upper and lower portions of the female connector 35. An operation lever 47 which can rotate around rotation supporting pins 57*a* is provided at one end of the upper and lower slide members 43. Since the upper and lower slide members 43 move in mutually opposite directions by the rotation of the operation lever 47, the female connector 35 is drawn into the hood section 27 of the male connector 25 when the slide members 43 and 45 slide in the mutually opposite directions.

10 Claims, 12 Drawing Sheets

CONNECTORS ENGAGEMENT STRUCTURE

BACKGROUND OF THE INVENTION

1. Field of the Invention

The present invention relates to a connectors engagement structure for mutually engaging male and female connectors together, by moving slide members in a direction to be orthogonal with a direction of an engagement of both connectors, guiding guide pins provided on either the surface of the slide members or the surface of one of the connectors into grooves provided on the surface of the other connector for drawing one connector into the other connector.

2. Description of the Related Art

As an engagement structure in the relevant technical field, there is, for example, one as disclosed in the Japanese Utility Model Application laid-Open No.3-74483. According to the description of this publication, by mutually bringing both a male connector and a female connector close to each other, the male connector is inserted into the female connector for mutual engagement. A large number of terminal metal members are accommodated in each of the connectors, and the terminal members are brought into contact with each other at the time of the connectors engagement, for achieving an electrical conduction between both connectors.

A guide pin formed in an engagement member moves together with this engagement member moves to a guide groove formed in one of the male and female connectors so as to be close to the male and female connectors, so that the guide groove moves by being guided by the guide pin. By this movement, either the male connector or the female connector on which the guide groove is formed moves and, as a result, the male connector and the female connector are brought close to each other and are then engaged together.

The guide groove is formed in a state of being slanted toward a moving direction of the engagement member. The guide groove is formed by a plurality of numbers on each of the upper and lower positions of one of the male and female connectors, and all of these guide grooves are formed in this slanted shape in one same direction. Accordingly, directions of force applied to the respective guide grooves from the guide pins generated at the time of inserting the engagement member are set in the same direction at the upper and lower positions, and since there is a suitable clearance between the male connector and the female connector, and between each guide pin and each guide groove, the male connector which is drawn into the female connector is slanted toward the female connector, which sometimes makes it impossible to achieve a smooth engagement operation. In such a situation, the terminal metal members of both connectors are brought into contact with each other in a mutually slanted state which may damage the terminal metal members and the connectors themselves.

SUMMARY OF THE INVENTION

The present invention is conceived to solve the above-described problems. It is an object of the present invention to provide a connectors engagement structure achieving a smooth operation of the engagement between a male connector and a female connector.

In order to achieve the above object, according to a first aspect of the present invention, there is provided a connectors engagement structure, comprising: a first connector; a second connector for engagement with the first connector in a mutually engaged direction; a first slide member being capable of slidingly moving in a first sliding direction intersecting the mutually engaged direction of the first and second connectors; a second slide member being capable of slidingly moving in a second sliding direction oppose to the first sliding direction of the first slide member; a first guide pin provided on one of the first slide member and the second connector; a second guide pin provided on one of the second slide member and the second connector; a first pin guiding portion having a groove provided on the other one of the first slide member and the second connector for engaging with the first guide pin, the first pin guiding portion formed in a first slanted direction slanting to the first sliding direction, a second pin guiding portion having a groove provided on the other one of the second slide member and the second connector for engaging with the second guide pin, the second pin guiding portion formed in a second slanted direction slanting to the second sliding direction, wherein the first and second slanted directions of the first and second pin guiding portions are formed in mutually opposite directions, and the first and second slide members slidingly move in mutually opposite directions, so that the first and second guide pins move within the first and the second pin guiding portions in the first and second slanted directions respectively, thereby the first and second connectors are closed to and engaged with each other.

According to a second aspect of the invention, as it depends from the first aspect, the first and second slanted directions of the first and second pin guiding portions are arranged symmetrically with respect to the mutually engaged direction of the first and second connectors in a view from a top of the first and second pin guiding portions.

According to a third aspect of the invention, as it depends from the second aspect, the first and second slide members are slidingly movably mounted on slide sections formed on the first connector having neither the first and second pin guiding portions nor the first and second guide pins.

According to a fourth aspect of the invention, as it depends from the first aspect, the connectors engagement structure further comprising: an operation member provided on the first connector at one end of the first and second sliding directions for moving the first and second slide members in the first and second sliding directions.

According to a fifth aspect of the invention, as it depends from the first aspect, the connectors engagement structure further comprising: a hood having a first opening for connection to the first connector having neither the first and second pin guiding portions nor the first and second guide pins and a second opening for connection to the second connector, the hood further having an operation member provided on the food at one end of the first and second sliding directions for moving the first and second slide members in the first and second sliding directions, wherein the first and second slide members are slidingly movably mounted on slide sections formed on the hood.

According to a sixth aspect of the invention, as it depends from the fifth aspect, the hood is provided with a plurality of stopping projection pieces having stopping grooves for being inserted with stopping projections provided on the first connector having neither the first and second pin guiding portions nor the first and second guide pins so that the hood is connected with the first connector.

According to a seventh aspect of the invention, as it depends from the sixth aspect, the plurality of stopping projection pieces and the stopping projections provided on the first connector are arranged so that the hood is mountable in two states of being mutually rotated by 180 degrees with a central axial line along the mutually engaged direction of the first and second connectors.

According to a eighth aspect of the invention, as it depends from the seventh aspect, the operation member is rotatable around an axis along the mutually engaged direction at one end of the first and second sliding directions, the axis locates between the first and second slide members, and one ends of each of the first and second slide members is rotatably mounted to the operation member.

According to a ninth aspect of the invention, as it depends from the eighth aspect, the operation member has a lever portion for slidingly moving the first and second slide members in the first and second directions by rotating the operation member, and the lever portion is in a close contact state with the hood so that the first and second connectors are mutually engaged.

According to a tenth aspect of the invention, as it depends from the first aspect, each of the first and second slide members has a flexible section at least one of its respective end section linked together, and the first and second slide members slidingly move in mutually opposite directions by a drive member engaged with the flexible section.

According to a eleventh aspect of the invention, a pair of slide members are provided so as to be movable in a direction orthogonal with an engagement of a male connector and a female connector and so as to sandwich one of the connectors from both sides at the time the engagement, guide grooves formed in a state of being slanted toward a moving direction of the slide members are provided on one of the mutually facing inner surface of the pair of slide members and the outer surface of the connector facing the slide members, guide pins which can be engaged with these guide grooves are provided on the other, so that the guide pins move within the guide grooves by the move of the slide members so as to draw the one connector into the other connector for achieving a mutual engagement of the connectors. In this connectors engagement structure, the guide grooves are formed such that the slant directions with respect to the move direction of the slide members are in mutually opposite directions on both sides of the connector on which the pair of slide members are disposed, so that the guide pins move within the guide grooves when the pair of slide members slidingly move in mutually opposite directions.

In the above-described structure, at the time of mutually engaging the male and female connectors, the pair of slide members are moved in mutually opposite directions in a state that the guide pins are inserted into the guide grooves so that the guide pins are guided into the guide grooves slanted in mutually opposite directions. Accordingly, directions of forces applied by the guide grooves or guide pins of the slide members to the guide pins or guide grooves of one of the connectors to be drawn become mutually different, so that the slanting between the male and female connectors is restricted, which enables a smooth engagement operation. As a result, terminal metal members are brought into normal contact with each other, and this makes it possible to prevent damaging of the terminal metal members and damaging of the connectors themselves.

According to a twelfth aspect of the present invention, as it depends from the eleventh aspect of the present invention, the guide grooves of which slanting directions are different are formed in a horizontally symmetrical pattern in a connectors engagement direction as viewed from the top of the guide grooves.

In the above-described structure, the forces applied by the move of the guide grooves or guide pins of the slide members to the guide pins or guide grooves of one of the connectors become mutually uniform on both sides of the connector, and the connectors engagement force becomes almost uniform as a whole to enable a smooth engagement operation.

According to a thirteenth aspect of the present invention, as it depends from the eleventh aspect of the present invention, the pair of slide members are movably mounted on a slide section formed on the other connector on which neither the guide grooves nor guide pins are provided.

In the above-described structure, at the time of the connectors engagement operation, the slide members can be smoothly inserted by being guided by the slide section.

According to a fourteenth aspect of the present invention, as it depends from the thirteenth aspect of the present invention, an operation section for slide moving the pair of slide members in mutually opposite directions is provided at one end of the slide members in the sliding direction.

In the above-described structure, when the operation section is operated, the pair of slide members are moved in mutually opposite directions with respect to the slide section of the other connector. Accordingly, the operation of slide moving the pair of slide members can be achieved smoothly by the operation section.

According to a fifteenth aspect of the present invention, as it depends from the eleventh aspect, a hood is provided which can have one connector having the guide grooves or guide pins mounted at one opening of the hood and which can have the other connector having neither the guide grooves nor guide pins inserted from the other opening of the hood, the pair of slide members are mounted movably on the slide section formed on the hood, and an operation section for slide moving the pair of slide members in mutually opposite directions is provided at one end of the slide members in the sliding direction.

In the above-described structure, when the other connector having neither guide grooves nor guide pins is mounted on one opening side of the hood and when the one connector is inserted from the other opening side of the hood in this state and the pair of slide members are slidingly moved in mutually opposite directions by the operation of the operation section in the state of the guide pins having being inserted into the guide grooves, then the guide pins move within the guide grooves and the other connector having the guide pins or guide grooves are drawn into the other connector side so that both connectors are brought into a mutual engagement. Accordingly, since the hood having the operation section can be mounted immediately before the mutual engagement of the male and female connectors, it becomes possible to prevent damaging of the operation section at the time of handling electric wires connected to the connector before the engagement of the connectors.

According to a sixteenth aspect of the present invention, as it depends from the fifteenth aspect, with respect to the other connector having neither guide grooves nor guide pins, the hood is mountable in two states of being mutually rotated by 180 degrees with a central axial line along the connectors engagement direction as a center.

In the above-described structure, when the hood is mounted in two states of being mutually rotated by 180 degrees with respect to the other connector, it becomes possible to set the operation section at a mutually 180 degrees rotated position, so that the using position is not limited, which improves the flexibility for general application.

According to a seventeenth aspect of the present invention, as it depends from the fourteenth or fifteenth aspects, the operation section can rotate around a rotation central axis provided in the extension along the connectors engagement direction at one end section of the other connector or the slide members of the hood in the sliding direction, and one end section of each of the pair of slide members is rotatably mounted at a position at which the rotation central axis is sandwiched.

In the above-described structure, when the operation section is rotated around the rotation central axis, the pair of slide members move in mutually opposite directions. Accordingly, the operation of slide moving the pair of slide members becomes possible by a simple operation of rotating the operation section.

According to an eighteenth aspect of the present invention, as it depends from the seventeenth aspect, the operation section has a lever section for slide moving the pair of slide members in mutually opposite directions by rotating the operation section by itself, and the lever section is in a close contact state with the other connector or the hood in the state that both connectors are mutually engaged.

In the above-described structure, when the lever section is rotated, the operation section rotates so that the pair of slide members slidingly move in mutually opposite directions. When the lever section is rotated until when both connectors have been mutually engaged, the lever section is brought into close contact with the other connector or hood. Accordingly, the increase in the size of the connector itself by the provision of the lever section to have improved operation can be minimized. Further, since the lever section rotates in a direction orthogonal with the engagement direction with respect to the other connector or hood at the time of the engagement operation, the drawing direction of the electric wires connected to the connector is not restricted, for an improved general application.

According to a nineteenth aspect of the present invention, as it depends from the eleventh aspect, the pair of slide members has at least one of its respective end sections linked together with a flexible section, and the slide members slidingly move in mutually opposite directions by a drive section interlocked with this flexible section.

In the above-described structure, when the drive section operates, the flexible section of the slide members moves in one direction so that the pair of slide members slidingly move in mutually opposite directions. Accordingly, it becomes possible to achieve a slide movement of the pair of slide members more smoothly.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIG. 4A is a side view and FIG. 4B is a plan view.

FIG. 5A is a side view and FIG. 5B is a plan view.

FIG. 6A is a side view and FIG. 6B is a plan view.

FIG. 7A is a side view and FIG. 7B is a plan view.

FIG. 11A shows a state that the operation lever faces upward and FIG. 11B shows a state that the operation lever faces downward.

DESCRIPTION OF THE PREFERRED EMBODIMENTS

Figure 1:
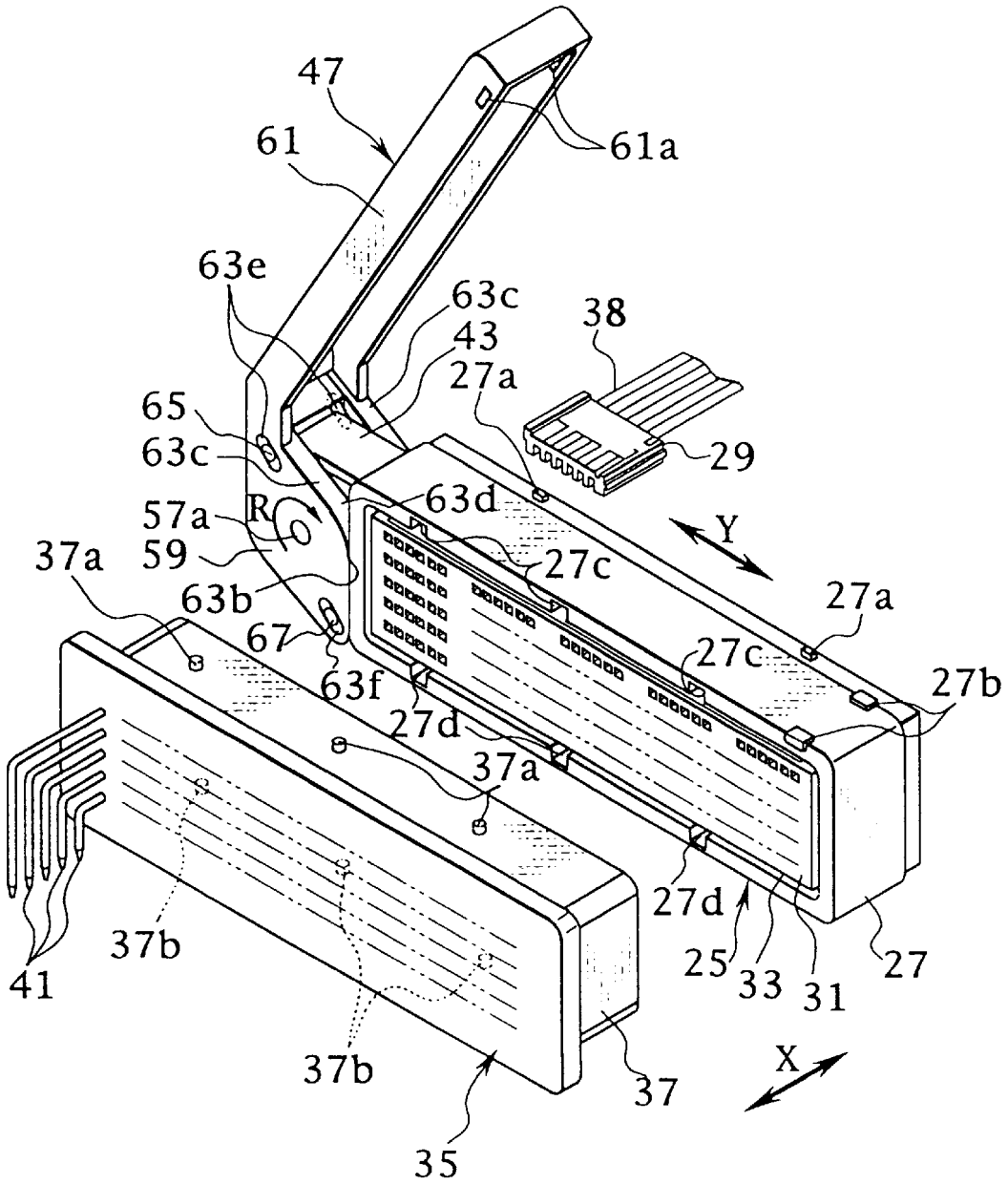
FIG. 1 is an exploded perspective view for showing a state that the male and female connectors are separated from each other according to one embodiment of the present invention.

There will be detailed below the preferred embodiments of the present invention with reference to the accompanying drawings. Like members are designated by like reference characters.

Figure 2:
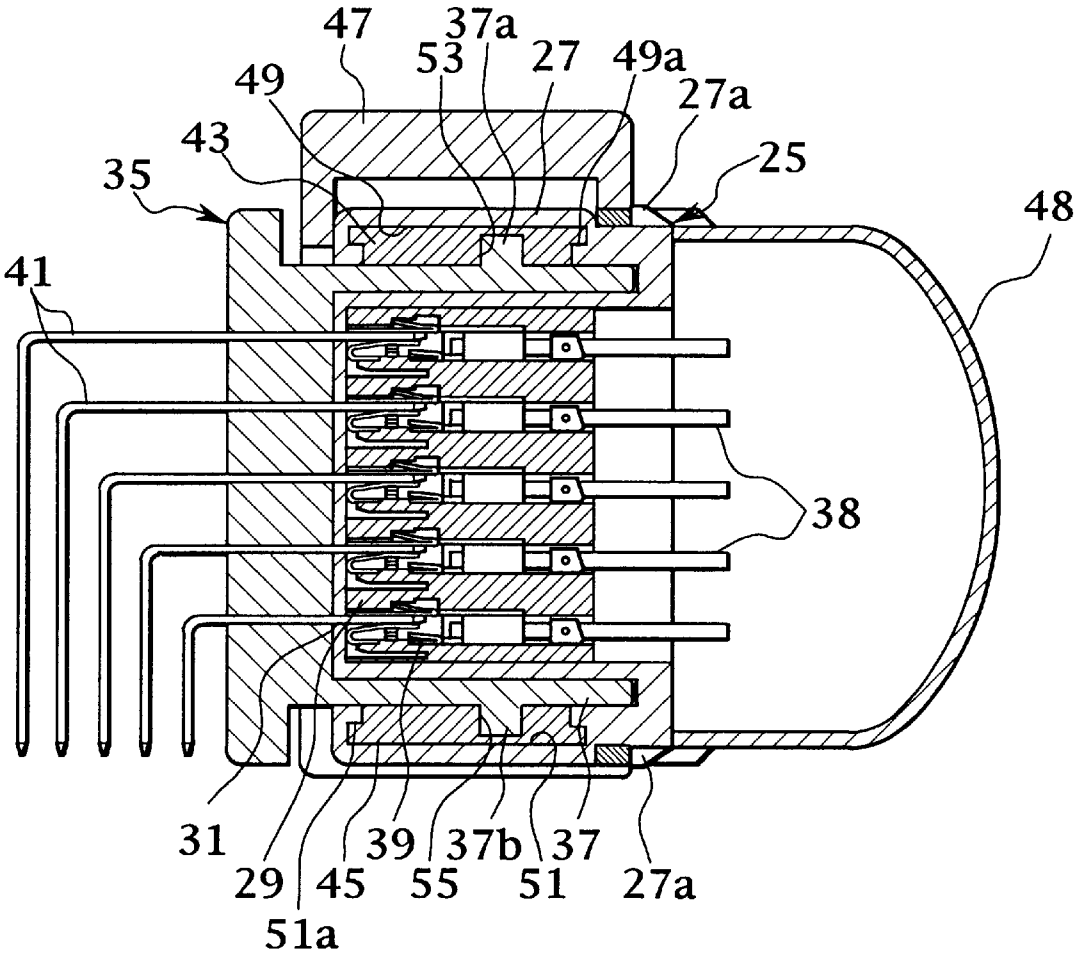
FIG. 2 is a cross sectional view for showing a state that the male and female connectors in FIG. 1 are engaged together.

FIG. 1 is a perspective view for showing a state that a male connector and a female connector are separated from each other, according to one embodiment of the present invention. A male connector 25 as a first connector has a hood section 27 for structuring an external wall and a male connector main body 31 on which a plurality of sub-connectors 29 are mounted. A hood section 37 of a female connector 35 as a second connector is inserted into a space 33 between the hood section 27 and the male connector main body 31, so that both connectors 25 and 35 are engaged in an arrow X direction as a mutually engaged direction. A plurality of pressing terminals 39 which are terminal metal members connected with electric wires 38 are fixed to the sub-connector 29, as shown in FIG. 2 which is a cross sectional view of both male and female connectors 25 and 35 being mutually engaged with each other. On the other hand, pin terminals 41 which are terminal metal members, one ends of that are inserted into the pressing terminals 39, are mounted on the female connector 35 piercing through it, as shown in FIG. 2, and the other ends of the pin terminals 41 bent in a L-shape outside the hood section 37 are mounted by welding on a printed circuit board (PCB), for example, not shown.

Figure 3:
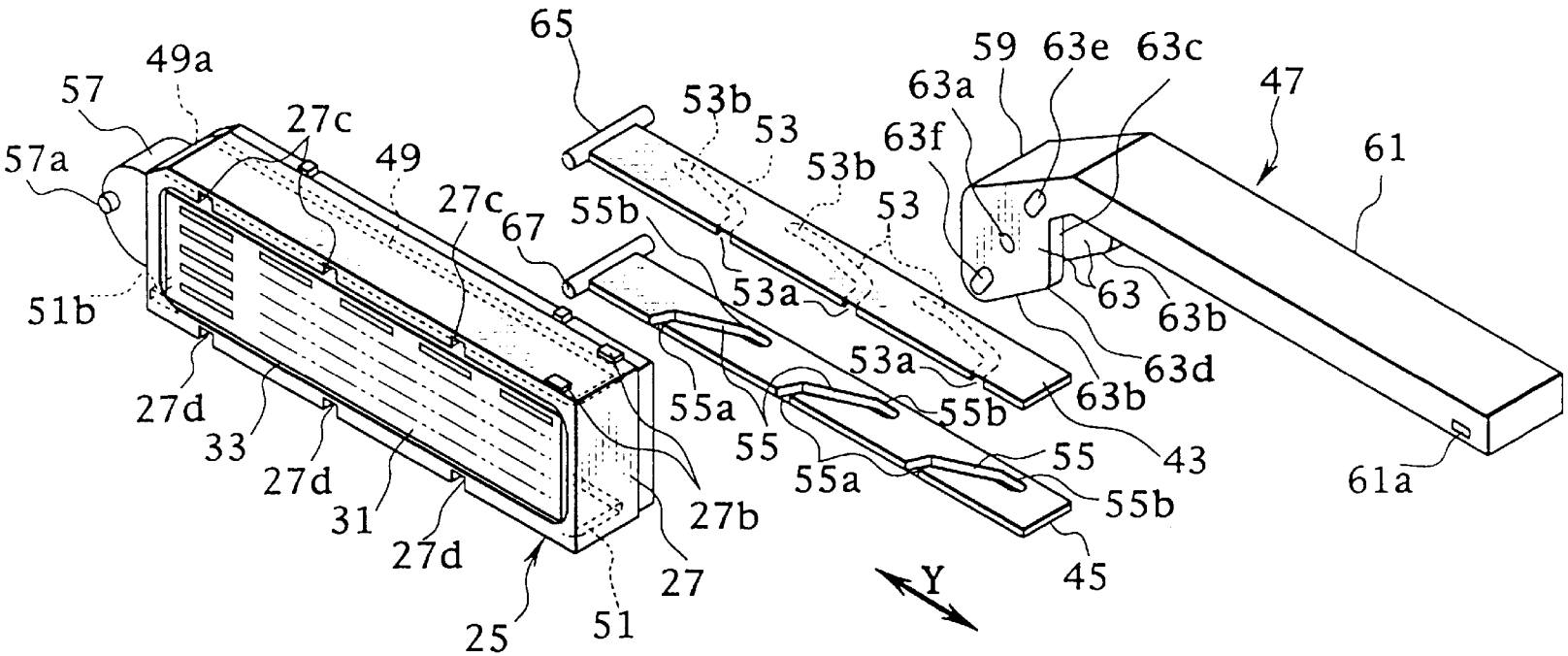
FIG. 3 is an exploded perspective view at the male connector side of FIG. 1.

As shown in an exploded perspective view in FIG. 3, the male connector 25 is mounted with a pair of slide members 43 and 45 as a first and a second slide members which slidingly move to the male connector 25 in an arrow Y direction as a first and second sliding directions which is a direction intersecting to and a direction orthogonal with the engagement direction shown by the arrow X in FIG. 1, and an operation lever 47 as an operation member for slide moving each of the slide members 43 and 45. Further, on the side opposite the side where the male connector 25 and the female connector 35 are engaged, a cover 48 is mounted by utilizing lock projections 27*a* provided on the upper and lower surfaces of the hood section 27, as shown in FIG. 2.

On the inner surface plane of the hood section 27 facing the space 33 between the male connector main body 31 and the hood section 27 on the upper and lower surfaces of the male connector main body 31 as shown in FIG. 3, slide grooves 49 and 51 as slide section for slide movably inserting the slide members 43 and 45 in itself are formed. As shown in FIG. 2, stages 49*a* and 51*a* are formed on the slide grooves 49 and 51 respectively so that the slide members 43 and 45 are supported by the hood section 27, and insertion holes 49*b* and 51*b* are formed at one end section in the longitudinal direction of the male connector 25 so that the slide members 43 and 45 are inserted from the insertion holes 49*b* and 51*b* respectively.

On the mutually facing surfaces of the slide members 43 and 45, guide grooves 53 and 55 as a first and a second pin guiding portions are formed with slanted directions as a first and a second slanted directions toward the insertion direction of the slide members 43 and 45 (the arrow Y direction in FIG. 1), with the slanting directions of the guide grooves 53 and 55 set in mutually opposite directions. In other words, the guide grooves 53 of the slide member 43 are open to one side edge (the side edge of the female connector 35 side in FIG. 1) and are continuous to introduction grooves 53*a* which are almost orthogonal with the side edge, and are formed to extend toward the insertion hole 49*b* side of the slide groove 49 from the introduction groove 53*a* side. On the other hand, the guide grooves 55 of the slide member 45 are open to one side edge (the side edge of the female connector 35 side in FIG. 1) and are continuous to introduction grooves 55*a* which are almost orthogonal with the side edge, and are formed to extend toward the opposite side of the guide grooves 53. At the front end sides of the guide grooves 53 and 55, end terminal grooves 53*b* and 55*b* which extend toward the sliding direction of the slide members 43 and 45 are formed respectively. The shape of the grooves formed by the introduction grooves 53*a*, the terminal grooves 53*b* and the guide grooves 53 and the shape of the grooves formed by the introduction grooves 55*a*, the terminal grooves 55*b* and the guide grooves 55 are horizontally symmetrical, when viewed from the top, with respect to the connectors engagement direction as shown in the arrow X of FIG. 1.

The operation lever 47 for slide moving the slide members 43 and 45 consists of a rotation section 59 fitted to a lever fitting section 57 formed on the end surface of the insertion holes 49*b* and 51*b* sides of the male connector 25, and a lever section 61. The rotation section 59 has a pair of rotation plates 63 disposed to sandwich the lever fitting section 57 from the both sides. Rotation supporting pin 57*a* as a rotation central axis formed in projection on both sides of the lever fitting section 57 are rotatably inserted into a rotation central hole 63*a* formed at the center of each rotation plate 63.

Each rotation plate 63 has a non-engagement-time contact surface 63*b* which is in contact with the end surface of the hood section 27 in the non-contact state of the connectors shown in FIG. 1 and an engagement-time contact surface 63*c* which is in contact with the end surface of the hood section 27 in the state of a connectors engaged state by rotating in an arrow R direction around the rotation supporting pin 57*a* from the state of FIG. 1, each rotation plate forming almost a rhombus shape. The contact surfaces 63*b* and 63*c* are continuously formed by a curve section 63*d*, to thereby facilitate a rotation work of the operation lever 47.

The lever section 61 has almost the same length as that of the length in the longitudinal direction of the male connector 25, and when the lever section 61 is rotated in the arrow R direction around the rotation supporting pins 57*a* from the state of FIG. 1 to a state of connectors engagement, the lever section 61 is brought into close contact with the upper surface of the hood section 27 of the male connector 25. In this close contact state, stopping holes 61*a* formed on both sides of the front end of the lever section 61 are engaged with stopping projections 27*b* formed on the upper surface of the hood section 27.

On each rotation plate 63 of the rotation section 59, long holes 63*e* and 63*f* are piercingly formed near the top point mutually facing on both sides in the longitudinal axis direction of the rhombus shaped section around the rotation central hole 63*a*. On the other hand, the end sections of the slide members 43 and 45 are provided with fitting projections 65 and 67 respectively which project in the width direction of the slide members 43 and 45. When the fitting projections 65 and 67 are inserted into the long holes 63*e* and 63*f* respectively, the end sections of the slide members 43 and 45 are fitted to the operation levers 47 side.

In the connectors non-engagement state shown in FIG. 1, the long hole 63*e* into which the slide member 43 at the upper side is fitted is positioned with a distance from the end surface of the hood section 27 of the male connector 25, and the long hole 63*f* into which the slide member 45 at the lower side is fitted is positioned near the end surface of the hood section 27, with these long holes 63*e* and 63*f* formed to have long shapes in a direction along a straight line connecting between the long holes 63*e* and 63*f*.

When the operation lever 47 is in the connectors non-engagement state as shown in FIG. 1, the upper side slide member 43 has its end section at the fitting projection 65 side projected from the slide groove 49, and on the other hand, almost all portion of the lower side slide member 45 is inserted into the slide groove 51. In other words, in this case, both slide members 43 and 45 are in a state of being mutually deviated from each other along the sliding direction by the difference between the distance from the long hole 63*e* to the end surface of the hood section 27 and the distance from the long hole 63*f* to the end surface of the hood section 27. In this state, the positions of the introduction grooves 53*a* and 55*a* formed on the slide members 43 and 45 are deviated respectively in the sliding direction so that the introduction grooves 53*a* and 55*a* are at the same position in the sliding direction.

In the above-described connectors non-engagement state, recesses 27*c* and 27*d* are formed on the hood section 27 of the male connector 25 corresponding to the introduction holes 53*a* and 55*a* respectively. On the other hand, on both the upper and lower surfaces of the hood section 37 of the female connector 35, guide pins 37*a* and 37*b* as a first and a second guide pins are formed so as to match with the recesses 27*c* and 27*d* respectively and so as to be movably inserted into the introduction grooves 53*a* and 55*a*, the guide grooves 53 and 55 and the terminal grooves 53*b* and 55*b* respectively at the time of engaging the connectors 25 and 35 with each other.

The operation of the above-described connectors engagement structure will be explained below with reference to FIG. 4A to FIG. 7B. In FIG. 4A to FIG. 7B, FIG. 4A, FIG. 5A, FIG. 6A and FIG. 7A show mainly positions of the operation lever 47, FIG. 4B, FIG. 5B, FIG. 6B and FIG. 7B show mainly positional relation between the guide grooves 53 and 55 and the guide pins 37*a* and 37*b* corresponding to the top plan views of FIG. 4A, FIG. 5A, FIG. 6A and FIG. 7A.

Figure 4A:
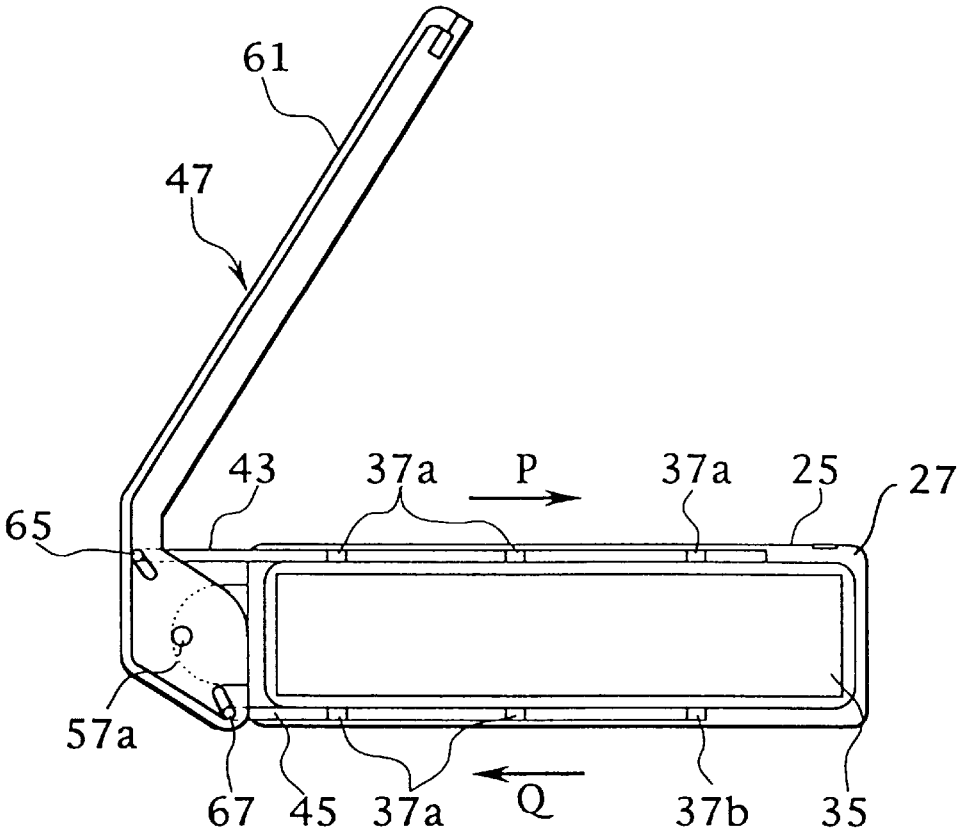
FIGS. 4A and 4B are explanatory diagrams of the operation of an initial stage of the engagement according to the connectors engagement structure of FIG. 1.
Figure 4B:
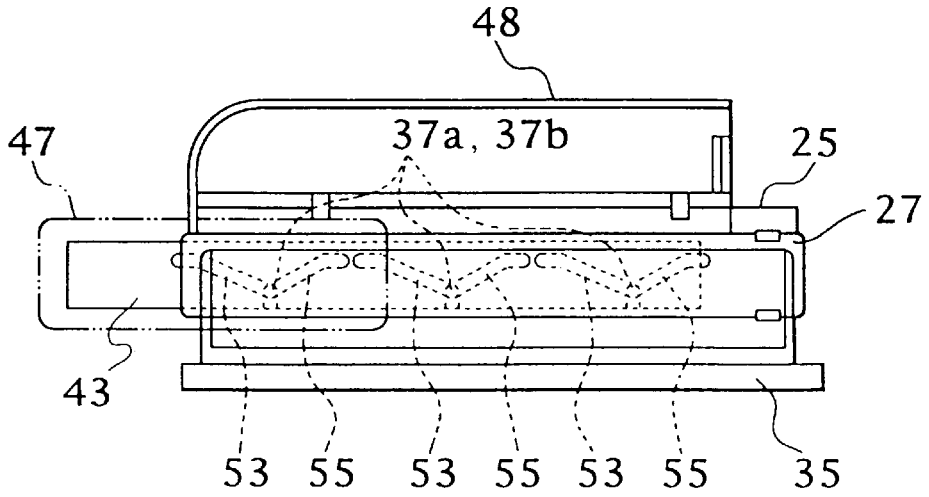

FIG. 4A and FIG. 4B show a connectors non-engagement state of FIG. 1. As shown in FIG. 4A, the lever section 61 of the operation lever 47 is positioned with the longest distance from the upper surface of the hood section 27 of the male connector 25, and the non-engagement-time contact surface 63*b* of the rotation plates 63 is in contact with the end surface of the hood section 27. When the hood section 37 of the female connector 35 is inserted in this state into the space 33 between the hood section 27 of the male connector 25 and the male connector main body 31, the guide pins 37*a* and 37*b* are inserted into the introduction grooves 53*a* and 55*a* of the slide members 43 and 45 through the recesses 27*c* and 27*d* of the hood section 27 respectively, as shown in FIG. 4B.

When the operation lever 47 is rotated around the rotation supporting pins 57*a* in the right direction from the state of FIG. 4A and FIG. 4B, the upper side slide member 43 slidingly moves in the right direction as shown by an arrow P and the lower side slide member 45 slidingly moves in the left direction as shown by an arrow Q, both in opposite directions. Along with the slide moving of these slide members, the guide pins 37*a* and 37*b* at the female connector 35 side move within the guide grooves 53 and 55 from the introduction grooves 53*a* and 55*a* respectively. At the same time with this move, the female connector 35 is drawn into the male connector 25.

Figure 5A:
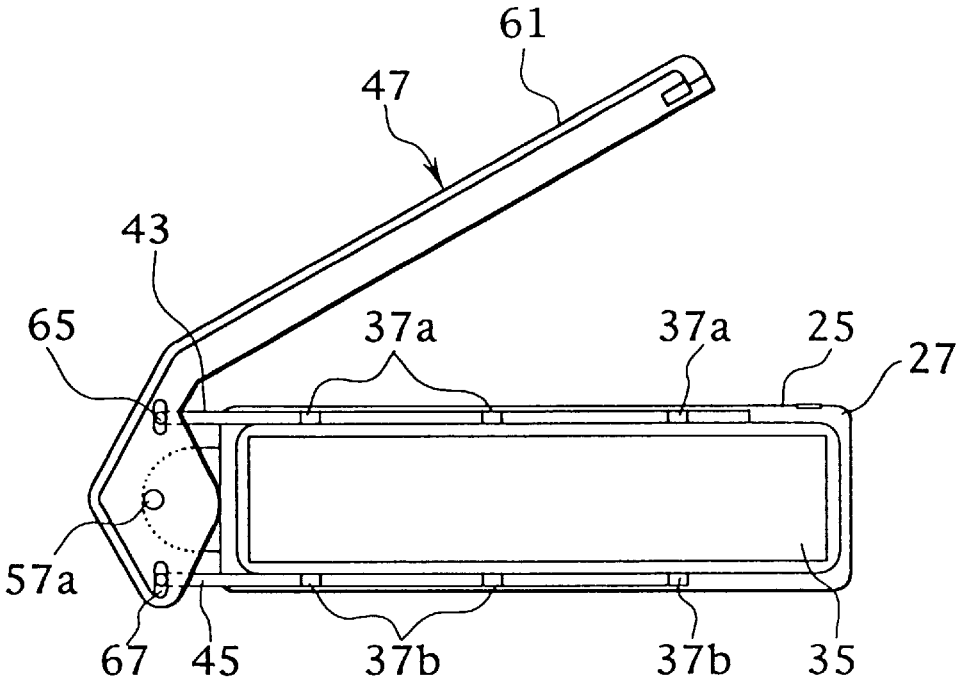
FIGS. 5A and 5B are explanatory diagrams of the operation of an intermediate stage of the engagement according to the connectors engagement structure of FIG. 1.
Figure 5B:
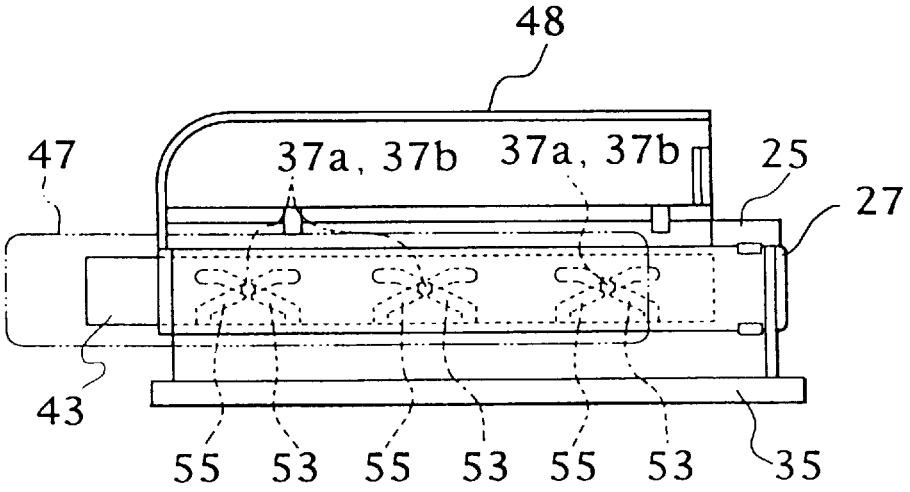

FIG. 5A and FIG. 5B show the state that the guide pins 37*a* and 37*b* have reached almost the center position of the guide groove 53 and 55. The operation lever 47 is in the state that the rotation plates 63 have rotated to the position where the center of the curve section 63*d* is in contact with the end surface of the hood section 27. In this case, the slide members 43 and 45 are at the same position without deviation in the sliding direction.

Figure 6A:
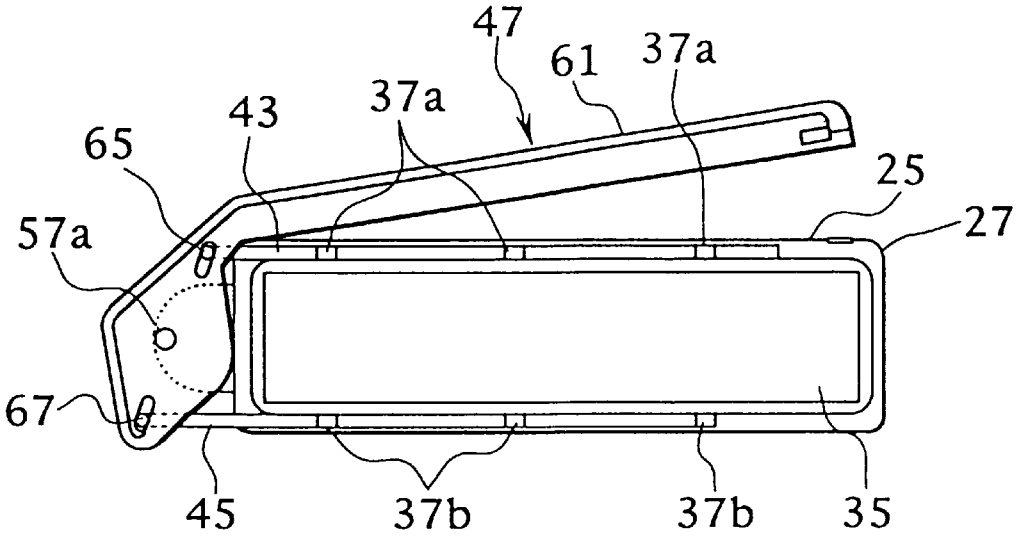
FIGS. 6A and 6B are explanatory diagrams of the operation of an intermediate stage of the engagement according to the connectors engagement structure of FIG. 1.
Figure 6B:
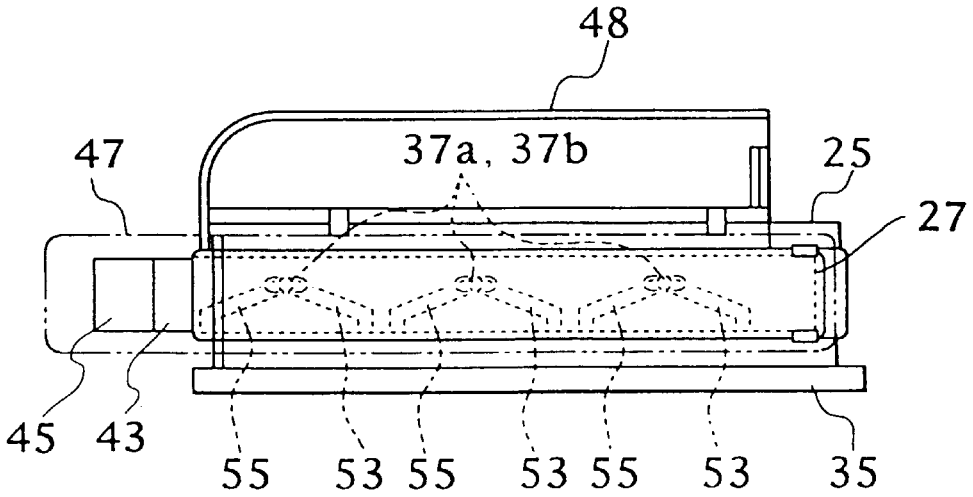

When the operation lever 47 is further rotated from the state of FIG. 5A and FIG. 5B to a position immediately before the lever section 61 is brought into close contact with the upper surface of the hood section 27 as shown in FIG. 6A and FIG. 6B, the guide pins 37*a* and 37*b* are inserted into the terminal grooves 53*b* and 55*b* respectively as shown in FIG. 6B. In this case, the operation of inserting the female connector 35 into the male connector 25 into the engagement direction is over, and the pin terminals 41 of the female connector 35 are inserted into the pressing terminals 39 of the male connector 25 side so that both connectors 35 and 25 are electrically connected with each other.

Figure 7A:
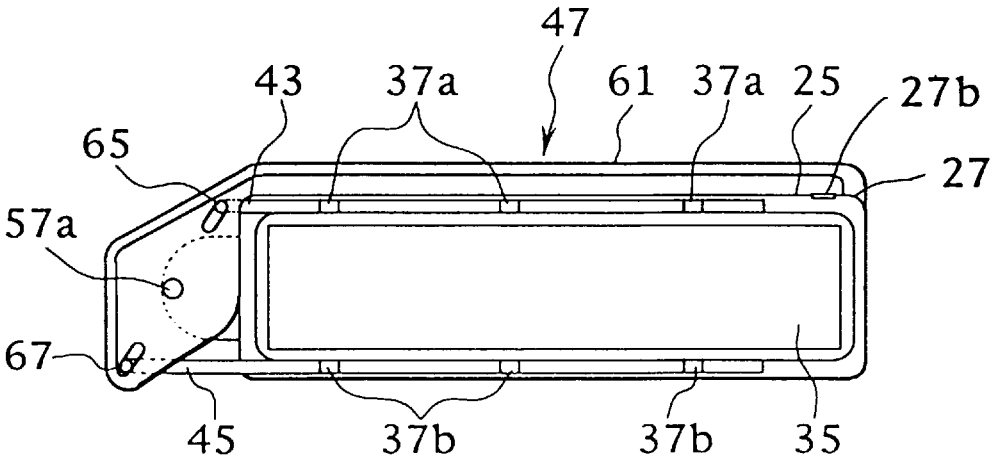
FIGS. 7A and 7B are explanatory diagrams of the operation of an end stage of the engagement according to the connectors engagement structure of FIG. 1.

When the operation lever 47 is further rotated from the state of FIG. 6A and FIG. 6B to a position where the lever section 61 is brought into close contact with the upper surface of the hood section 27 as shown in FIG. 7A, the engagement-time contact surface 63*c* of the rotation plates 63 is brought into contact with the end surface of the hood section 27 so that the guide pins 37*a* and 37*b* reach the top end position of the terminal grooves 53*b* and 55*b* respectively. In this state, the stopping holes 61*a* (not shown in the figure) at the top end of the lever section 61 are engaged with the stopping projections 27*b* on the upper surface of the hood section 27, and the operation lever 47 is locked to the hood section 27, thus finishing the engagement operation. In this case, almost the whole of the upper side slide members 43 enter the slide groove 49 and the lower side slide members 45 are projected from the slide groove 51 at the end portion of the fitting projection 67 side.

Figure 7B:
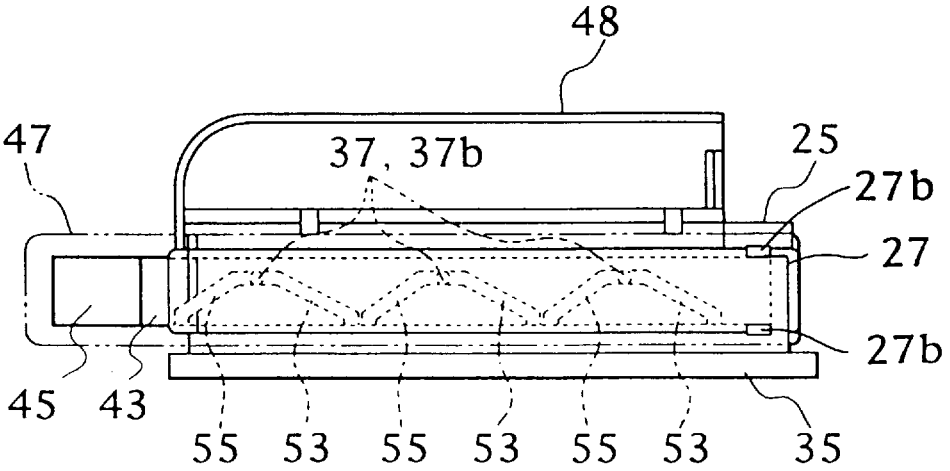

In order to disengage the male connector 25 from the female connector 35 in the connectors engaged state as shown in FIG. 7A and FIG. 7B, the locking of the stopping holes 61*a* with the stopping projections 27*b* is canceled and then the operation lever 47 is rotated in the direction opposite to the above operation.

According to the above-described connectors engagement structure, since the upper and lower guide pins 37*a* and 37*b* at the female connector 35 side are guided into the guide grooves 53 and 55 which are slanted in mutually opposite directions by the slide move of the slide members 43 and 45 in mutually opposite directions at the time of drawing the female connector 35 into the male connector 25 for their engagement, the respective directions of the force of the guide grooves 53 and 55 contributing to the guide pins 37*a* and 37*b* become mutually opposite so that the slanting of the female connector having the guide pins 37*a* and 37*b* to the male connector 25 is restricted, which enables a smooth engagement operation.

Further, since the guide grooves 53 and 55 are horizontally symmetrical when viewed from the top with respect to the connectors engagement direction shown by the arrow X in FIG. 1, the force applied to the guide pins 37*a* and 37*b* respectively becomes mutually equal, so that the engagement force is almost balanced as a total for ensuring a smooth engagement operation. As a result, the mutual slanting and contacting of the pressing terminals 39 at the male connector 25 side and the pin terminals 41 at the female connector 35 side can be avoided, so that damaging of the pressing terminals 39 and the pin terminals 41 and damaging of the connectors themselves can be prevented.

Further, at the time of operating the operation lever 47 between the state of FIG. 4A and FIG. 4B and the state of FIG. 7A and FIG. 7B, the operation lever 47 can be smoothly rotated by the curve section 63*d* which is continuously and smoothly connected between the contact surfaces 63*b* and 63*c* of the rotation plates 63. Since the rotation operation of the lever section 61 of the operation lever 47 is carried out at the upper portion of the hood section 27, the direction of drawing the electric wires 38 is not restricted, which increases the flexibility of application. Further, since the lever section 61 is locked to the upper surface of the hood section 27 by a mutual close contact in the state after the operation of engagement between the male connector 25 and the female connector 35, the increase in the size of the connectors themselves due to the provision of the operation lever 47 for the improved operation efficiency can be minimized.

Figure 8:
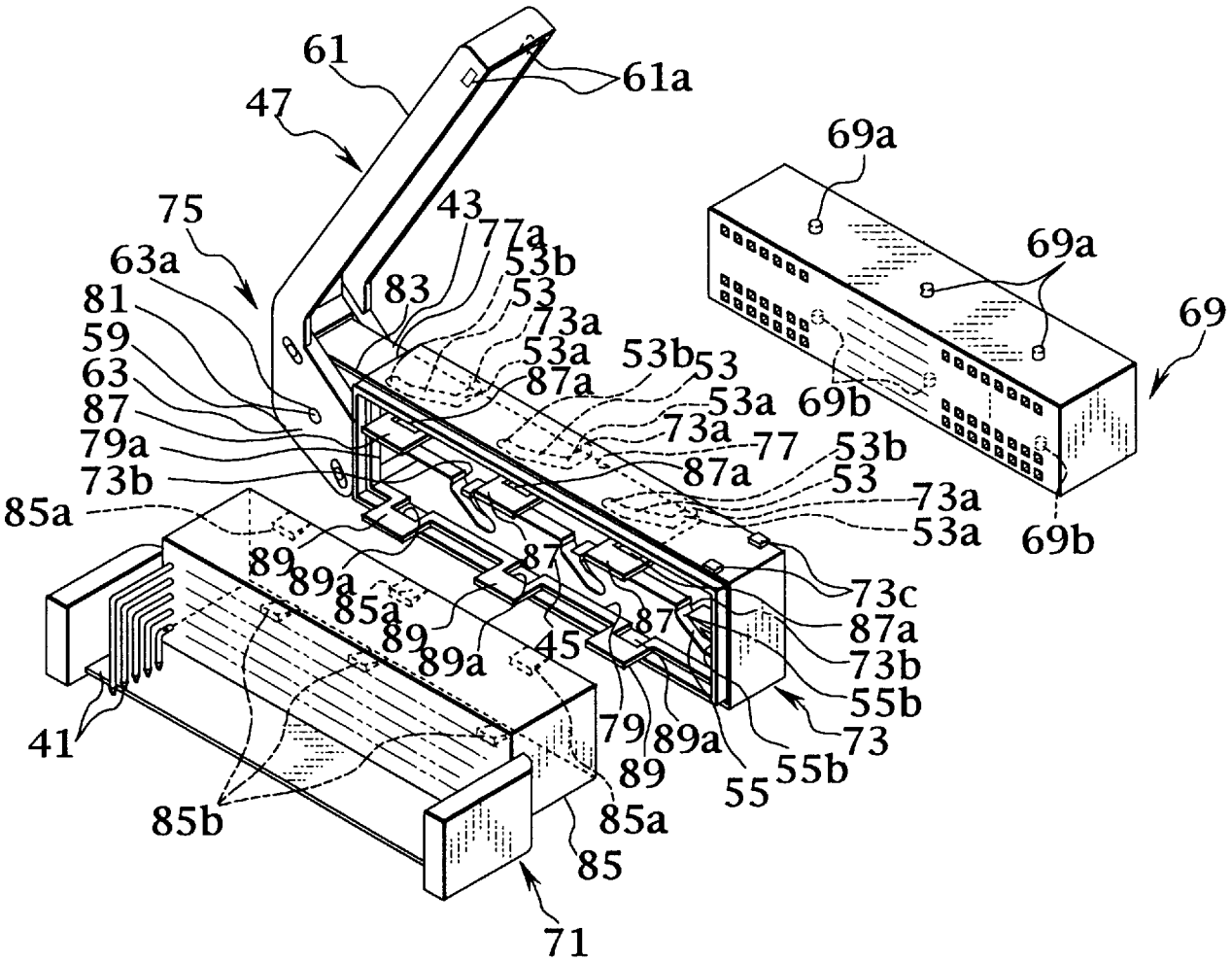
FIG. 8 is an exploded perspective view for showing a state that the male and female connectors are separated from each other according to another embodiment of the present invention.
Figure 9:
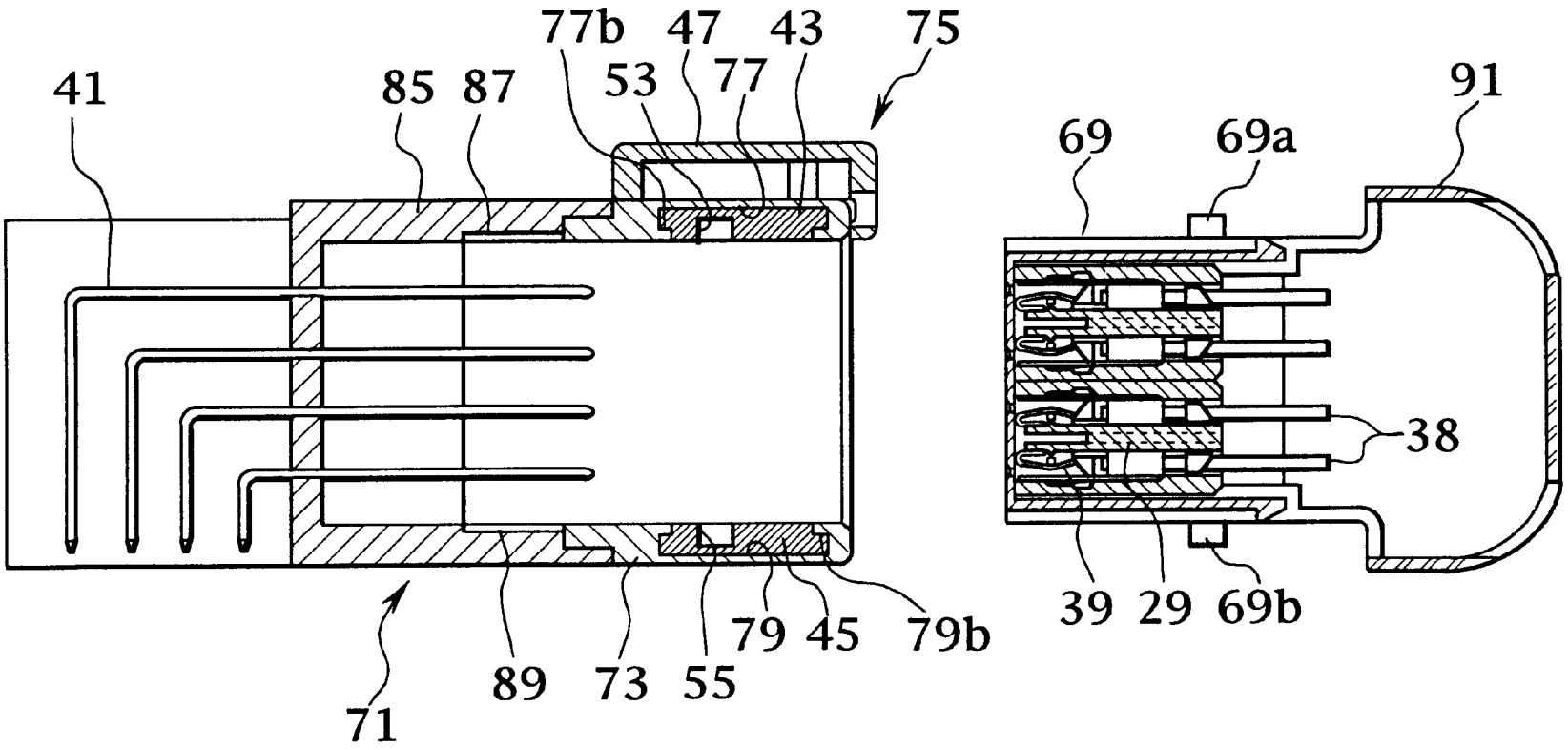
FIG. 9 is a cross sectional diagram for showing a non-engaged state of the engagement structure of the connectors in FIG. 8.
Figure 10:
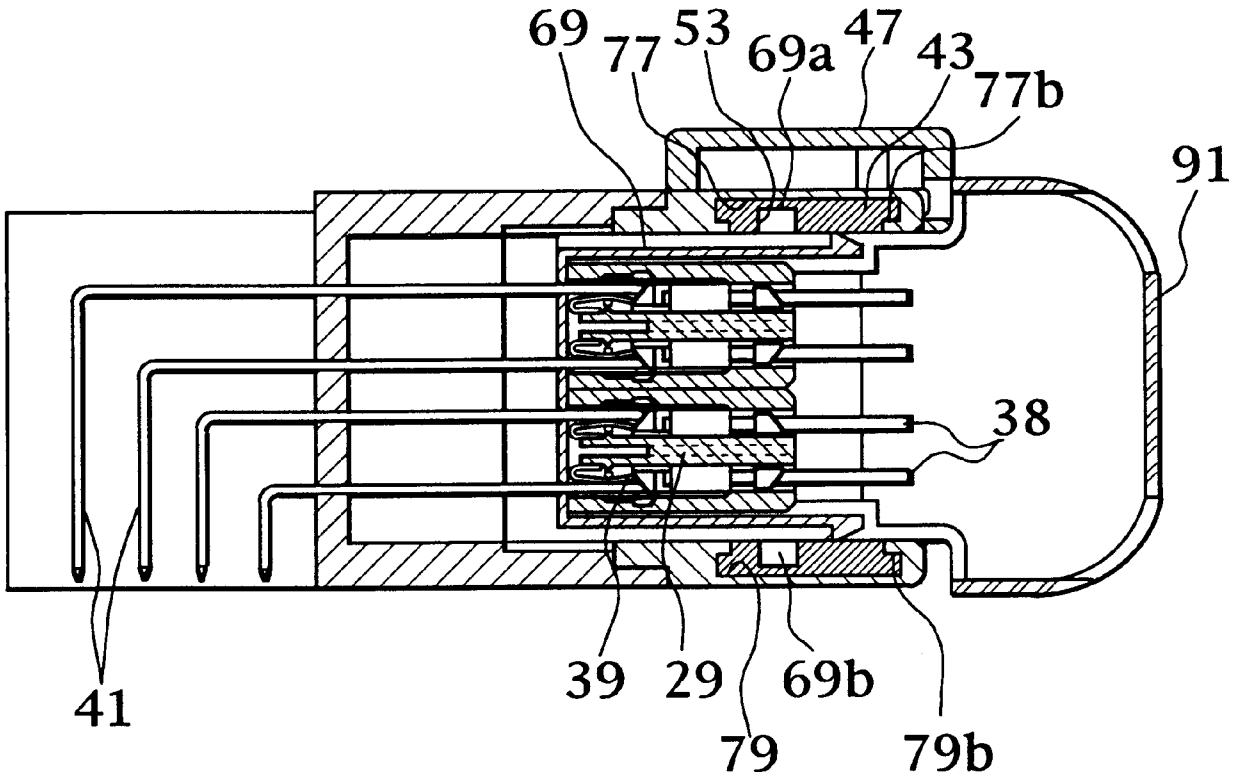
FIG. 10 is a cross sectional diagram for showing an engaged state of the engagement structure of the connectors in FIG. 8.

FIG. 8 is a perspective view for showing the state that the male and female connectors are separated, relating to another embodiment of the present invention. According to this embodiment, in addition to a male connector 69 as a second connector and a female connector 71 as a first connector, there is provided a hood assembly 75 which includes a hood 73 for covering the outer periphery of the male connector 69, a pair of slide members 43 and 45 which can slidingly move in the longitudinal direction of the hood 73, and an operation lever 47 for engaging the male connector 69 with the female connector 71 by slide moving the slide members 43 and 45. The hood assembly 75 can have the female connector 71 mounted on one opening provided on the female connector 71 side and can have the male connector inserted into the other opening provided on the other side. A non-engagement state of the male and female connectors 69 and 71 in the state that the hood assembly 75 is fitted to the female connector 71 is shown in FIG. 9, and an engagement state of the connectors is shown in FIG. 10, as cross sectional views respectively.

The above-described slide members 43 and 45 have introduction grooves 53*a* and 55*a,* guide grooves 53 and 55 and terminal grooves 53*b* and 55*b,* and the operation lever 47 has a rotation section 59 and a lever section 61, in the same manner as that of FIG. 1 and FIG. 3. Further, the state of connection of these parts is also the same as that of FIG. 1 and FIG. 3. However, the introduction grooves 53*a* and 55*a* are open to the side edge of the male connector 69 side which is opposite to the positions of FIG. 1 and FIG. 3, and the guide grooves 53 and 55 are slanted to the opposite directions to those of FIG. 1. The hood 73 corresponds to the hood section 27 of the male connector 25 in FIG. 1, and the slide members 43 and 45 slidingly move in mutually opposite directions in the slide grooves 77 and 79 as the slide section on the upper and lower sides of the hood 73. The slide grooves 77 and 79 are formed with insertion openings 77*a* and 79*a* for inserting the slide members 43 and 45 at the operation lever 47 side, in the same manner as that shown in FIG. 1 and FIG. 3, and are also formed with stages 77*b* and 79*b* as shown in FIG. 9 and FIG. 10, so that the slide members 43 and 45 are supported by the hood 73.

At the end surface of the hood 73 where the operation lever 47 is fitted, rotation supporting pins 81 are formed on both sides, and a lever fitting section 83 to be inserted between a pair of rotation plates 63 is formed. The rotation supporting pins 81 are rotatably inserted into the rotation central hole 53*a* of the rotation plates 63. Further, on the upper surface of the end section opposite to the lever fitting section 83 of the hood 73, stopping projections 73*c* which can stop in stopping holes 61*a* formed on the side of the front end of the lever section 61 are provided.

In the connectors non-engagement state shown in FIG. 8, recesses 73*a* and 73*b* are formed at the side edge of the hood 73 corresponding to the introduction grooves 53*a* and 55*a* respectively of the slide members 43 and 45. On the other hand, on the upper and lower surfaces of the male connector 69, guide pins 69*a* and 69*b* are formed respectively which match with the recesses 73*a* and 73*b* and are movably inserted into the introduction grooves 53*a* and 55*a,* the guide grooves 53 and 55 and the terminal grooves 53*b* and 55*b* at the time of engaging both connectors 69 and 71.

The female connector 71 has stopping projections 85*a* and 85*b* formed by three respectively on the inner surface mutually facing the upper and lower surfaces of the hood section 85. Stopping projection pieces 87 and 89 having stopping grooves 87*a* and 89*a* respectively are formed at the side edge on the upper and lower surfaces opposite to the side of the recesses 73*a* and 73*b* of the hood 73 corresponding to the stopping projections 85*a* and 85*b*. When the stopping projection pieces 87 and 89 are inserted into the hood section 85 and the stopping projections 85*a* and 85*b* are stopped by the stopping grooves 87*a* and 89*a*, the hood assembly 75 is mounted on the female connector 71.

Figure 11B:
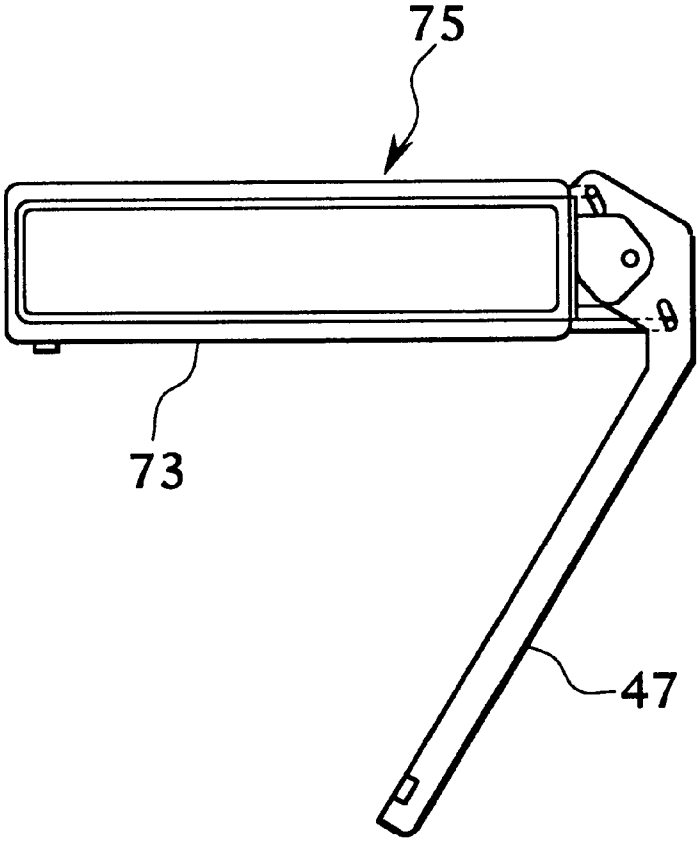
FIGS. 11A and 11B are front views of a hood assembly for showing a position of an operation lever with respect to a connector in the engagement structure of the connectors in FIG. 8.

The above-described hood assembly 75 has such a structure that the stopping section consisting of the stopping projections 85*a* and 85*b* and the stopping grooves 87*a* and 89*a* are vertically symmetrical so that the operation lever 47 can be mounted on the hood section 85 of the female connector 71 even if the direction of the operation lever 47 has changed from the up-facing state as shown in FIG. 11 which is in the same state as that in FIG. 8 to the down-facing state as shown in FIG. 11B after a rotation of 180 degrees around the central axis line along the connectors engagement direction.

A cover 91 is mounted on the side opposite to the hood 73 of the male connector 69 as shown in FIG. 9 and FIG. 10, although not shown in FIG. 8.

According to the above-described connectors engagement structure, in the state that the hood assembly 75 is mounted on the female connector 71 as shown in FIG. 9, the male connector 69 is inserted into the hood 73 from the opposite side of the female connector 71 and the guide pins 69*a* and 69*b* of the male connector 69 are inserted into the introduction grooves 53*a* and 55*a* through the recesses 73*a* and 73*b* of the hood 73 to thereby rotate the operation lever 47. With this arrangement, the guide pins 69*a* and 69*b* move within the guide grooves 53 and 55 and the male connector 69 is drawn into the hood section 85 of the female connector 71, so that both connectors 69 and 71 are engaged.

Figure 11A:
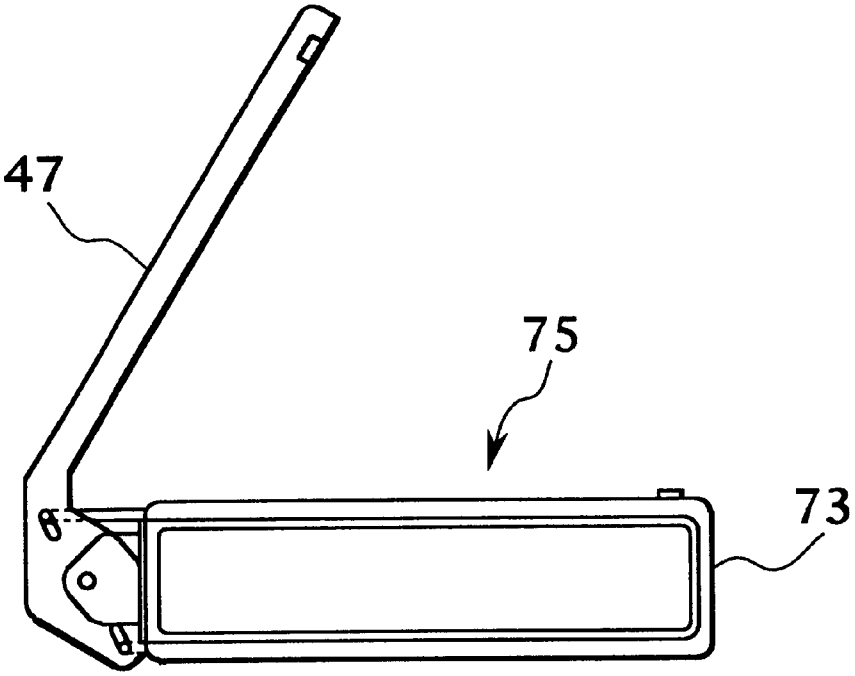

Since the hood assembly 75 having the operation lever 47 can be mounted immediately before the engagement of the male and female connectors 69 and 71 by the above-described connectors engagement structure, damaging of the operation lever 47 at the time of handling the wire harness (electric wires 38) before the connectors engagement which can become a problem in the case of the operation lever 47 being fitted to the male connector 25 having the electric wires 38 can be avoided. Further, since the hood assembly 75 can be mounted on the hood section 85 of the female connector 71 even if the operation lever 47 has changed from the state of facing upward as shown in FIG. 11A similar to the state as shown in FIG. 8 to the state of facing downward by making a 180 degrees rotation as shown in FIG. 11B, the position of using the operation lever is not limited so that the flexibility of the application can be increased.

In the state of the female connector 71 having been mounted on a PCB not shown, other part can be mounted on the PCB in the state that the hood assembly 75 is not mounted on the female connector 71. Therefore, the operation lever 47 does not become a hindrance at the time of mounting other part, thus preventing the deterioration of work efficiency.

Although each of the above-described embodiments has the structure that the guide grooves 53 and 55 are provided at the side of the slide members 43 and 45 and the guide pins 37*a,* 37*b,* 69*a* and 69*b* are provided at the side of the connectors 35 and 69, the same effect can also be obtained when, contrary to the above case, the guide pins are provided at the side of the slide members 43 and 45 and the guide grooves are provided at the side of the connectors 35 and 69.

Figure 12:
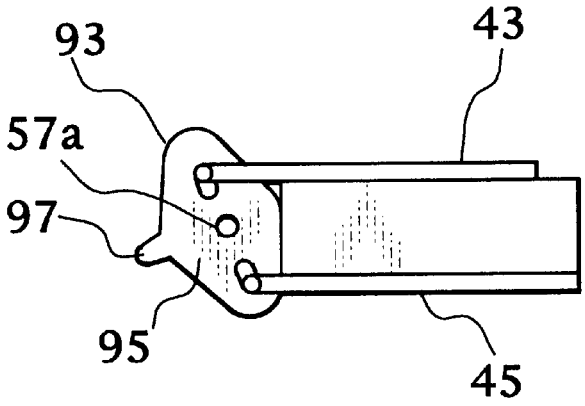
FIG. 12 is a schematic side view for showing still another embodiment of the invention.
Figure 13:
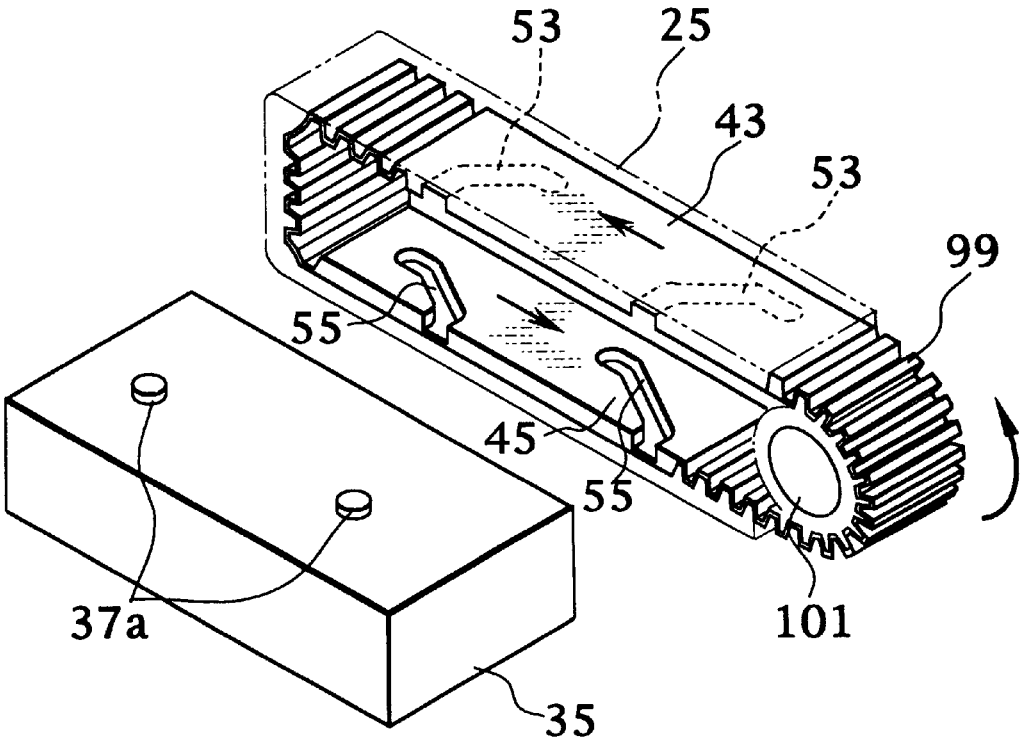
FIG. 13 is a perspective view for showing a still further embodiment of the invention in which a pair of slide members are integrated together with a flexible section.

Further, as to the operation section 93 for slide moving the slide members 43 and 45, an operation projection 97 may be provided as a projection at a rotation section 95 as shown in FIG. 12, instead of the lever section 61 as shown in FIG. 1 and FIG. 8 as a still another embodiment. As a still further embodiment, as shown in FIG. 13, a pair of slide members 43 and 45 may also be mutually integrated by connecting with a geared belt 99 as a flexible section so that the pair of slide members 43 and 45 are slidingly moved in mutually opposite directions by the rotation of a drive gear 101, used as a drive member or an operation member based on an engagement of the geared belt 99 and the drive gear 101 as a drive section.

While preferred embodiments of the present invention have been described using specific terms, such description is for illustrative purposes, and it is to be understood that changes and variations may be made without departing from the spirit or scope of the following claim.

What is claimed is:

1. A connector engagement structure, comprising:

a first connector;

a second connector having first and second guide pins, for engagement with the first connector in a mutually engaging direction;

a first slide member slidably movable in a first sliding direction intersecting the mutually engaging direction, the first sliding member having a first pin guiding portion to be engaged with the first guide pin, the first pin guiding portion being slanted in the first sliding direction; and a second slide member slidably movable in a second sliding direction opposite the first sliding direction of the first slide member, the second sliding member having a second pin guiding portion to be engaged with the second guide pin, the second pin guiding portion being slanted in a second sliding direction opposite the first sliding direction.

2. The connector engagement structure according to claim 1, wherein the first and second slanted directions of the first and second pin guiding portions are arranged symmetrically with respect to the mutually engaged direction of the first and second connectors in a view from a top of the first and second pin guiding portions.

3. The connector engagement structure according to claim 1, further comprising:

an operation member provided on the second connector, the operation member being configured to slidably move the first and second slide members in opposite directions at the same time and move first and second guide pins in the first and second guiding portions in the first and second sliding directions, respectively, thereby to engage the first and second connectors with each other.

4. The connector engagement structure according to claim 1, further comprising:

a hood having a first opening for connection to the second connector, the hood further having an operation member provided on the hood at one end of the first and second sliding directions for moving the first and second slide members in the first and second sliding directions, wherein the first and second slide members are slidingly movably mounted on slide sections formed on the hood.

5. The connector engagement structure according to claim 1, wherein each of the first and second slide members has a flexible section at least one of its respective end section lined together, and the first and second slide members slidingly move in mutually opposite directions by an operation member engaged with the flexible section.

6. The connector engagement structure according to claim 2, wherein the first and second slide members are slidably mounted on slide sections within the first connector.

7. The connector engagement structure according to claim 4, wherein the hood is provided with a plurality of stopping projection pieces having stopping grooves for being inserted with stopping projections provided on the first connector the hood being connected with the first connector.

8. The connector engagement structure according to claim 7, wherein the plurality of stopping projection pieces and the stopping projections provided on the first connector are arranged so that the hood is mountable in two states of being mutually rotated by 180 degrees with a central axial line along the mutually engaged direction of the first and second connectors.

9. The connector engagement structure according to claim 8, wherein the operation member is rotatable around an axis along the mutually engaged direction at one end of the first and second sliding directions, the axis located between the first and second slide members, and one ends of each of the first and second slide members is rotatably mounted to the operation member.

10. The connector engagement structure according to claim 9, wherein the operation member has a lever portion for slidingly moving the first and second slide members in the first and second directions by rotating the operation member, and the lever portion is in a close contact state with the hood so that the first and second connectors are mutually engaged.

* * * * *